United States Patent [19]

Nobuta et al.

[11] Patent Number: 4,871,001

[45] Date of Patent: Oct. 3, 1989

[54] DEVICE FOR FILLING VISCOUS MATERIAL

[75] Inventors: Masao Nobuta, Naruto; Tetsuya Iuchi, Tokushima, both of Japan

[73] Assignee: House Food Industrial Company, Ltd., Japan

[21] Appl. No.: 138,840

[22] Filed: Dec. 28, 1987

[51] Int. Cl.[4] ..... B65B 3/12

[52] U.S. Cl. ..... 141/279; 222/536; 141/82; 141/250; 141/258; 141/284; 141/78; 141/242

[58] Field of Search ..... 141/278, 279, 280, 258–262, 141/283, 284, 270, 82, 72, 73, 74, 77, 78, 80, 129, 136, 250, 237, 242; 222/533, 536, 330, 255, 275

[56] References Cited

U.S. PATENT DOCUMENTS

| | | | |
|---|---|---|---|
| 3,383,442 | 5/1968 | Mountain | 222/533 X |
| 3,695,486 | 10/1972 | Warner | 141/242 X |
| 3,817,300 | 6/1974 | Donnet | 141/117 |
| 4,015,560 | 4/1977 | Paul | 141/250 X |
| 4,019,547 | 4/1977 | Ross | 141/11 |
| 4,192,361 | 3/1980 | Moser | 141/82 |
| 4,192,430 | 3/1980 | James, Jr. et al. | 141/12 |
| 4,300,603 | 11/1981 | Laub, III | 141/258 |
| 4,373,560 | 2/1983 | Elsworth | 141/129 |
| 4,688,609 | 8/1987 | Diaz | 141/82 |

*Primary Examiner*—Ernest G. Cusick

*Attorney, Agent, or Firm*—Mason, Fenwick & Lawrence

[57] ABSTRACT

A device for filling a container with a highly viscous fluid substance comprises a tank for receiving the fluid substance of high viscosity; a communicating tube provided with a mechanism for discharging the substance in a constant flow rate and in communication with the tank; a filling nozzle connected to the discharging side of the communication tube and disposed so that a downward oriented discharge outlet thereof is positioned just above a path of a conveyor for transporting containers; an arm having an upper portion and a lower portion and to which the filling nozzle provided with a spool is mounted on the lower portion thereof; a horizontal axle supporting the arm in a freely rotatable and reversible manner at the upper portion thereof; and a mechanism for vibrating the arm on the horizontal axle serving as the vibration center. This filling device makes it possible to fill the container with a fluid substance having a high viscosity as smooth as possible without filling the container to overflowing since it is provided with a mechanism for vibrating the nozzle for filling the container with the substance.

4 Claims, 12 Drawing Sheets

DEVICE FOR FILLING VISCOUS MATERIAL

BACKGROUND OF THE INVENTION

1. Technical Field of the Invention

The present invention relates to a device for filling viscous materials and more particularly to a device for filling a container with a fluid substance having a high viscosity, such as curry roux.

2. Description of the Prior Art

In the field of, particularly in food industry, it is needed to fill an appropriate container such as paper packs, plastic cups and bottles with a rather viscous substance. For this purpose, there have been proposed various method therefor. For instance, as shown in FIG. 13, the aforementioned fluid substance (W) having a viscosity of, for instance, not less than 10,000 centipoise has conventionally been charged in an appropriate container through a single nozzle (N). However, in such a case, the container is filled with the fluid substance to overflowing, which makes it impossible to properly seal the container with a cover and such method requires the use of a proper means for flattening the substance charged in the container. In addition, a method in which a plurarity of nozzles (N) are used for filling a container with the substance, as shown in FIG. 14, has been put into practical use in order to solve the foregoing problem. However, this method is still insufficient to completely eliminate such a drawback.

In order to make the fluid substance filled in a container more smooth, it seems to be most effective to vibrate the container with an appropriate means. To do this, there has conventionally been proposed a method in which a compressed air flow is intermittently injected to the bottom of a container while filling it with a highly viscous substance. However, this method suffers from various problems to be solved, such as those mentioned below. First, the intermittent injection of the compressed air is effected by the switching (on-off) operation of an electromagnetic valve, however, the use of such a valve is insufficient in its durability. Secondly, a sanitary problem is caused depending on the quality of the compressed air used, while even if the quality thereof is good, the compressed air disturbs the conditions of atmospheric air, which leads to the occurrence of other sanitary problems such as the contamination of the substance to be filled in a container by various dusts.

SUMMARY OF THE INVENTION

Accordingly, it is in general a purpose of the present invention to provide a device for filling a container with a highly viscous substance, provided with a leveling device, which can eliminate the aforementioned drawbacks associated with the conventional filling device.

More specifically, it is a primary purpose of the present invention to provide a device for filling a container with a fluid substance having a high viscosity of not less than 3,000 centipoise, in particular not less than 10,000 centipoise without heaping a container with such a viscous substance, in other words, a device capable of filling a container with such a substance as flat as possible without the accompanying aforementioned problems.

It is another purpose of the present invention to provide a device for filling a container with such a viscous substance, which never causes the change in the filled amount of the substance with time even if the filling operation is continued for a long period of time and makes it possible to fill the container with a stable and constant amount of the viscous substance.

It is a further purpose of the present invention to provide a device for filling a container with a viscous substance, which is small in size as a whole and permits the stable and constant filling operation of the substance while eliminating the necesssity of constructing the same in an oversized scale by placing a tank and a constant feeding device with a large difference in height therebetween.

It is other purpose of the present invention to provide a device for filling a container with a viscous substance, in which a passage of the substance is maintained at a proper temperature, the water repellency is imparted to the surface thereof, the clearance of the sliding portions of nozzles and spools for feeding the highly viscous substance is not changed throughout the filling operations and it can run without any trouble and which is capable of stable and constant filling operation.

The aforementioned and other purposes according to the present invention can effectively be achieved by providing a device for filling a container with a highly viscous fluid substance, which comprises a tank for receiving the fluid substance of high viscosity; a communicating means provided with a means for discharging the fluid substance in a constant flow rate and communicated to the tank; a filling nozzle connected to the discharging side of the communicating means and disposed so that a downward oriented discharge outlet thereof is positioned just above a path of a conveyor for transporting containers; an arm having an upper portion and a lower portion and to which the filling nozzle provided with a spool is mounted on the lower portion thereof; a horizontal axis supporting the arm in a freely rotatable and reversible manner at the upper portion thereof; and a means for vibrating the arm on the horizontal axis serving as the vibration center.

According to another aspect of the present invention, there is provided a device for filling a container with a fluid substance of high viscosity and the device comprises a tank; a constant feeding device for discharging the substance at a constant flow rate, communicated to the tank; an intermittently driving slat-conveyor provided with holes for inserting containers and slats receiving, at the peripheral part thereof, a brim of the container formed around the edge of an opening thereof, to be filled with the highly viscous substance; a hammer for giving a blow to the container, comprised of a shank and a hammer head fixed at one end of the shank; a reversible, rotatable driving axle horizontally disposed so that, when the other end of the shank is fixed and the axle reversibly rotated, the hammer head can give a blow to the bottom of the container received by the slat standing still at its desired position; and a member for preventing the container from jumping out, which faces at least part of the peripheral portion of the opening of the container and is spaced apart from the peripheral portion of the opening at a distance smaller than the height of the container.

BRIEF DESCRIPTION OF THE DRAWINGS

The present invention will hereunder be explained in more detail with reference to the accompanying drawings in which:

FIG. 1 is a vertical sectional view thereof,

FIG. 2 is an elevational view,

FIG. 3 is a sectional view taken along the line III—III of FIG. 2,

FIG. 4 is a sectional view taken along the line IV—IV of FIG. 2 and

FIG. 5 is a sectional view taken along the line V—V of FIG. 2;

FIG. 6 is a plan view thereof,

FIG. 7 is an elevational view,

FIG. 8 is a side view,

FIG. 9 is a sectional view taken along the line IX—IX of FIG. 7 and

FIG. 10 is a sectional view taken along the line X—X of FIG. 8;

FIG. 11 is a plan view thereof and FIG. 12 is a side view thereof;

DESCRIPTION OF THE PREFERRED EMBODIMENTS

Figure 11:
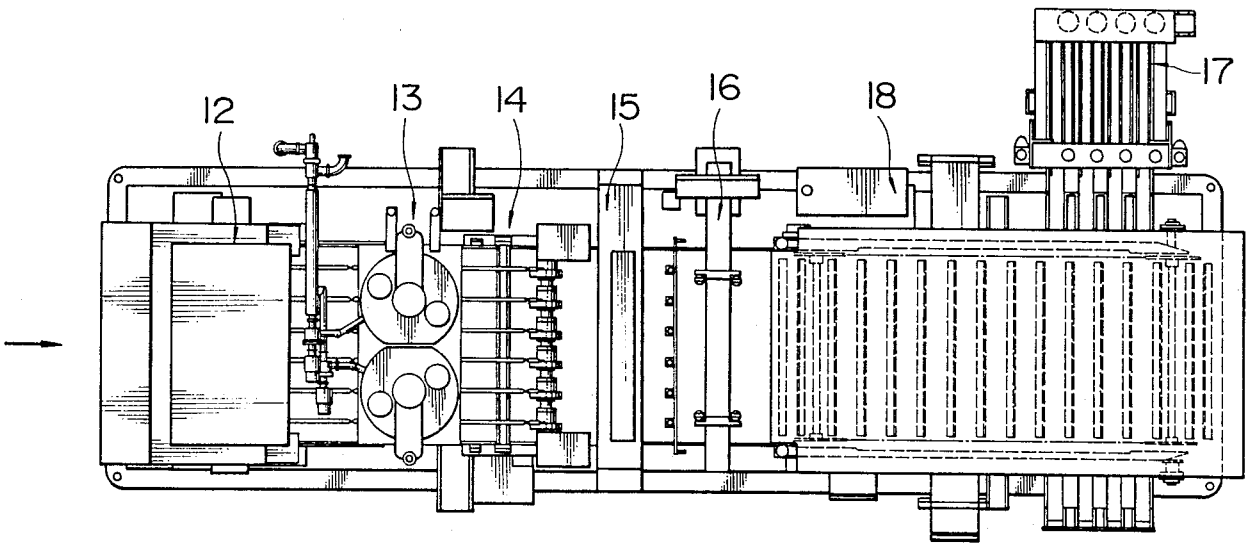
FIGS. 11 and 12 show schematic views of the whole of the packaging machine comprised of the aforementioned both devices.
Figure 12:
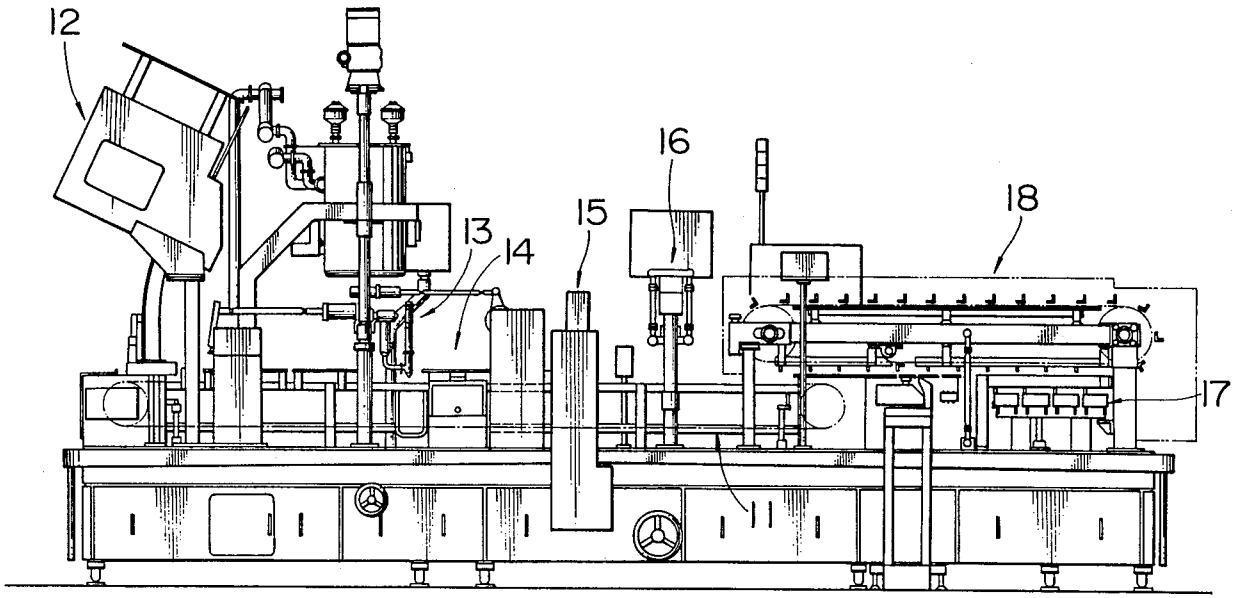
Figure 13:
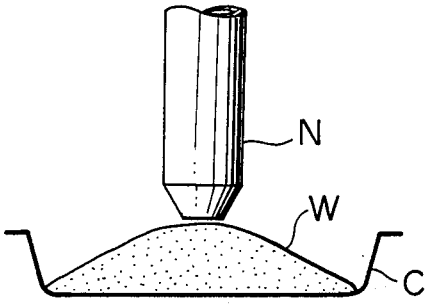
FIG. 13 PRIOR ART
FIGS. 13 and 14 are diagrams for illustrating the filling operations of a conventional device.
Figure 14:
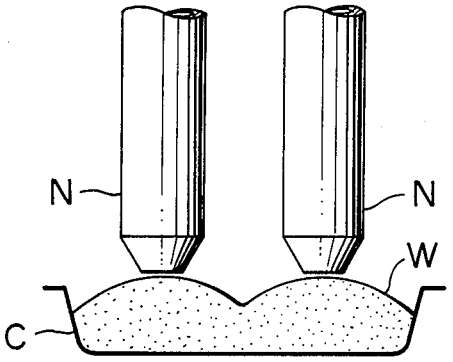
FIG. 14 PRIOR ART

A packaging machine comprising the device according to the present invention is provided with a slat-conveyor 11 as shown in FIGS. 11 and 12 which schematically illustrate it as a whole. The term "before, front or ahead" herein means the direction along which containers are transported by the conveyor on the basis of the transporting direction along which the conveyor moves (the direction towards the right hand side in FIG. 11 and 12) while the term "behind, rear or back" herein means the direction opposite to the foregoing direction. In addition, the directions "right and left" are herein defined with respect to the direction "before, front or ahead". A device 12 for transporting containers is disposed at the starting point of the transporting path along which the slat-conveyor 11 moves and, behind the slat-conveyor, there are disposed a series of devices comprising, in order, a filling device 13, a leveling device 14, a capping device 15 and a device 16 for sealing the cap. Moreover, a belt conveyor 17 is disposed before the slat-conveyor 11, having a transporting path which extends towards the left hand side from a position before the slat-conveyor as the starting point and a container exchanging device 18 is placed and extends from the end point of the path of the slat-conveyor 11 to the starting end of the path of the belt conveyor 17.

Among the foregoing devices, those except for the slat-conveyor 11, the filling device 13 and the leveling device 14 are not directly involved in the device of the present invention and further conventional such devices per se may be used in the present invention. Therefore, the explanation thereof is herein omitted for the sake of simplicity.

The slat-conveyor 11 is properly shown in FIGS. 1 to 10 and is provided with a pair of right and left endless chains 21 which are disposed parallel to each other and move in a cycle in a vertical plane and a large number of slats 22 extending therebetween and fixed thereto. Six holes 23 having an approximately ellipsoidal cross section are formed on each of the slats 22 along its longitudinal direction so that the major axis of the ellipsoid coincides with the longitudinal direction of the slats 22. Brims of dish-like containers C are received and supported by the slats at the periphery of the holes. In this connection, the chain 21 is intermittently drived by a means for driving the same (not shown).

As shown in FIGS. 1 to 5, the filling device 1 3 comprises two tanks 31 for containing fluid substances disposed above the slat-conveyor 11 and its right and left sides in a parallel relation; six cylinders 34 for filling the container with the substance, each including a piston 33 therein and each three of the cylinders being connected to, at the bottom, either of the tanks 31 through a vertical connecting tube 32; six nozzles 37 for filling the container with the substance, each of them being connected to and supported, so as to be able to freely vibrate, by each of the cylinders 34 through a horizontal axle 35 and an arm 36; and a means for vibrating the arm 36 on the horizontal axle 35 serving as the vibration center.

An outlet tube 38 is mounted on the bottom wall of each tank 31, which is preferably provided with a device for maintaining the internal pressure thereof (not shown), and the upper end of the connecting tube 32 is communicated to this outlet tube. A spool valve 39 for opening and shutting the internal passage of the tube is disposed in the middle of the connecting tube 32. The spool valve 39 is disposed so as to be perpendicular to the connecting tube 32 and it consists of a cylindrical housing 40 extending toward the front and rear directions and spool 42 provided with a vertical communicating path 41 which is contained within the housing 40 and which serves to communicate the upper and lower ends of the connecting tube 32. The spool 42 has a rod 43 projecting toward the front direction and to the front end thereof is connected a rod 44 which goes ahead and back by the action of a means not shown. A hot water jacket 45 is provided for preventing the fluid substance from causing solidification, which encompasses approximately the whole housing 40 and a part of the connecting tube 32 downward projecting through the housing 40.

The cylinder 34 for filling the container with the fluid substance is composed of a trunk wall 46 extending toward both the front and rear directions and parallel to the housing 40 of the spool valve 39; and an end wall 47 which closes the front end of the trunk wall 46. An inlet 48 is upward disposed on the trunk wall 46 at the front end thereof and it is connected to the lower end of the connecting tube 32. At the vicinity of the lower portion of the end wall 47, there is provided an outlet 49 having a size smaller than that of the inlet 48. The piston 33 has a rod 50 projecting backward and to the rear end of the rod is connected a rod 51 which goes ahead and back by the action of a means not shown.

The horizontal axle 35 extends toward both the front and rear directions and is secured, at the rear end thereof, to the end wall 47 of the cylinder 34 for filling so as to close the outlet 49 of the cylinder. The horizontal axle 35 has bores 52 axially formed, having closed bottoms and extending toward the front direction from the rear end of the axle and bores 53 radially formed, extending downward from the front end of the axle, and the opening at the rear end of the axially formed bores 52 is engaged with the outlet 49.

The arm 36 also serves as a conduit for transporting the fluid substance from the filling cylinders 34 to the filling nozzles 37 and is comprised of a vertical upper tube 54 and an L-shaped (side view) lower tube 55 which are in communication with one another. A cylindrical part 56 turning sideways is disposed at the upper end of the upper tube 54, which is slidably fitted to and inserted the wide portion of the outer surface of the horizontal axle 35 inclusive of the periphery of the opening of the radially, formed hole 53 opened at the outer surface of the axle. A hot water jacket 57 is disposed so as to enclose whole of the upper tube including the cylindrical part 56. On the outer surface of the hot water jacket 57, there is provided a forward projecting convex portion 58 to be engaged with the concave portion of a connecting bar 66.

The filling nozzles 37 have a cylindrical shape, an inlet tube 59 is backward disposed near the lower end of the outer periphery of the nozzles and the inlet tube is connected to the top of the lower tube 55 of the arm 36. The inner surface of the filling nozzles 37 has a uniform diameter and is smooth even at the discharge opening 60 positioned at the lower end thereof. A spool 61 is inserted into the nozzle. The surface of the nozzle and the spool which are slidably brought into contact with each other are preferably made of ceramics. On the other hand, at the upper end of the filling nozzle 37, a cylindrical case 62 and the nozzle 37 are arranged so as to lay on a straight line. At the upper end of the case 62, a fluid pressure cylinder 63 is downward disposed so as to close the opening of the case. The piston rod 64 thereof extends within the case 62 and connected to the upper end of the spool 61 through a connecting member 65.

The means for vibrating the nozzles comprises a horizontal connecting bar 66 which bridges over the arms 36 and a fluid pressure cylinder 70 provided with a piston rod 69 connected to the left end portion (in FIG. 2, right end portion) of the connecting bar 66 through a pair of male and female connecting members 67 and 68. At the lower edge of the connecting bar 66, there are formed, along the length thereof, six concave parts 71 to be engaged with the nozzles at constant intervals equal to that between the nozzles 37. Each of these concave parts 71 is engaged with each of the corresponding convex part 58 for engaging.

Figure 5:
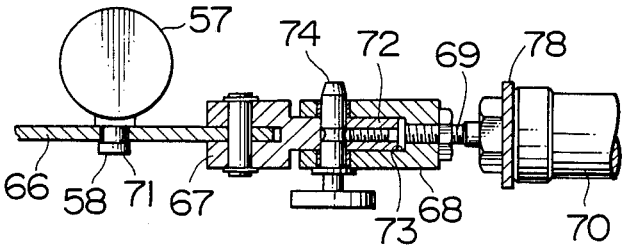

As shown in FIG. 5 in more detail, a convex part 72 is formed on the male connecting member 67 and a concave part 73 is formed on the female connecting member 68. Thus, a connecting pin 74 can be passed through the male and female connecting members while engaging the convex part 72 with the concave part 73. The connecting pin 74 may freely be inserted in and withdrawn from the both connecting members 67 and 68 and, therefore, the both connecting members 67 and 68 may be freely disengaged by inserting therein or withdrawing therefrom, the connecting pin.

Figure 2:
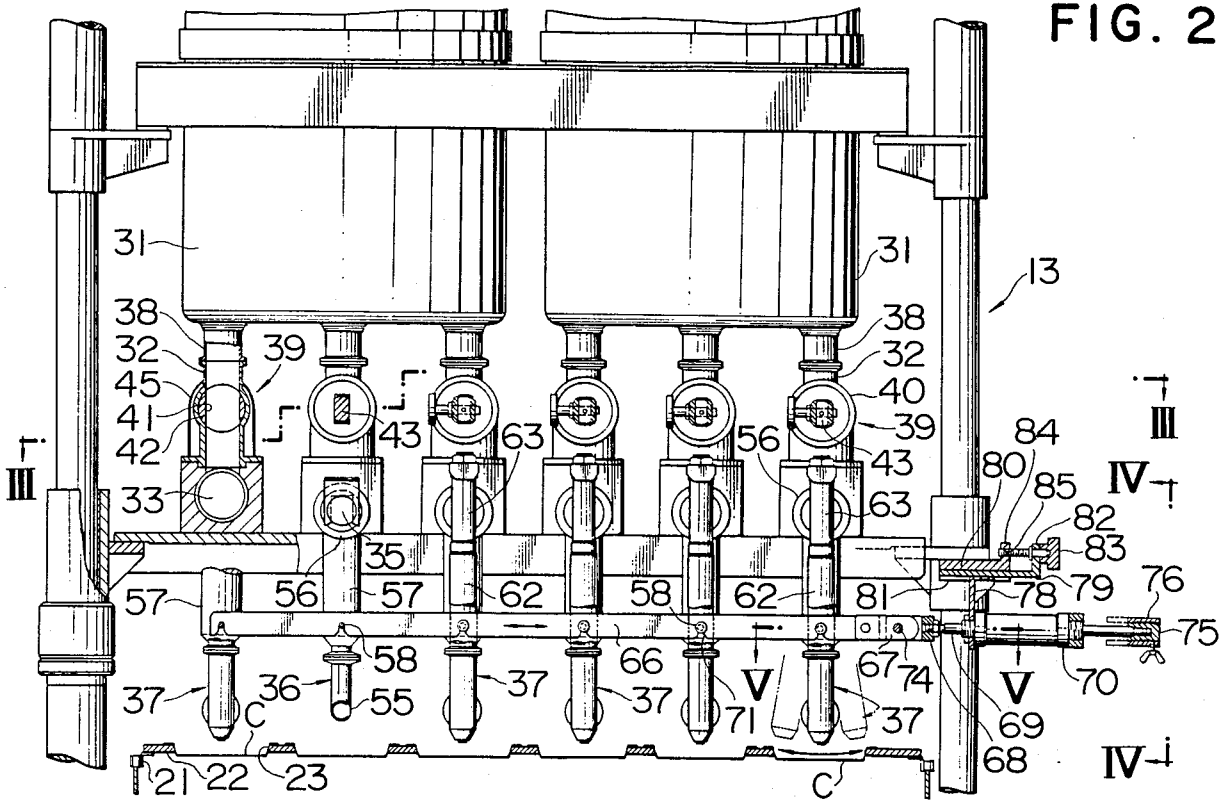
Figure 3:
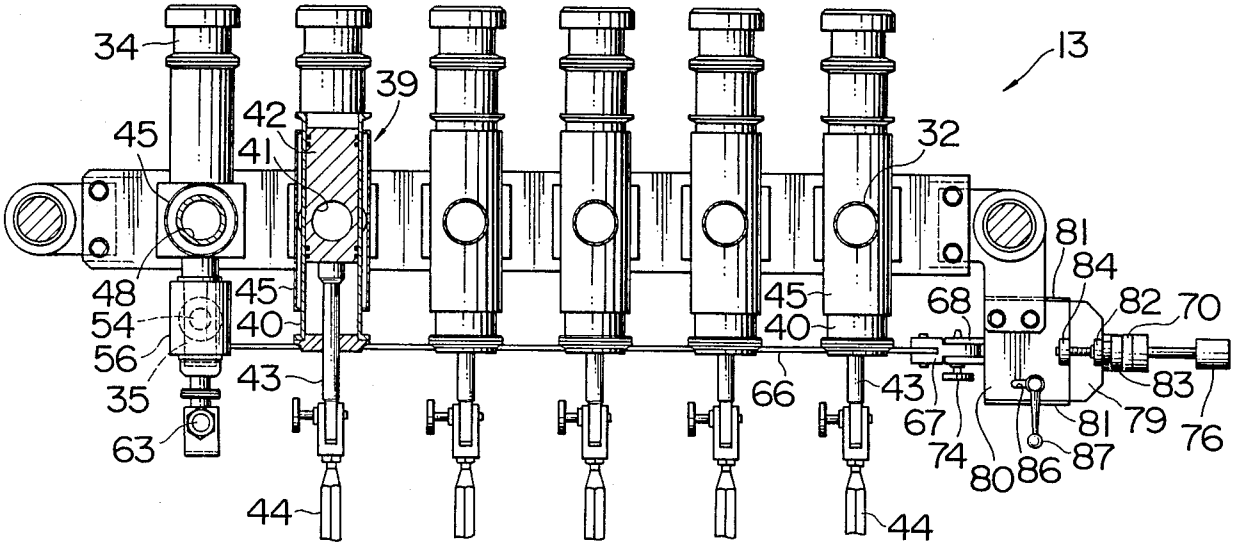

As seen from FIG. 2, the piston rod 69 of the fluid pressure cylinder 70 projects not only in the right direction but also in the left direction of the fluid pressure cylinder 70, a cylindrical male screw member 75 is screwed at the pointed end of the cylinder 70 and a cylindrical female screw member 76 is screwed on the male member. The female screw member 76 serves as a stopper for the piston, rod 69 and thus the stroke distance during movement back and forth of the rod 69 is controlled by bringing the member 76 into contact with the end wall of the fluid pressure cylinder 70. For this reason, it becomes possible to adjust the magnitude of the vibration angle of the nozzle 37 as will be described below in more detail.

Figure 4:
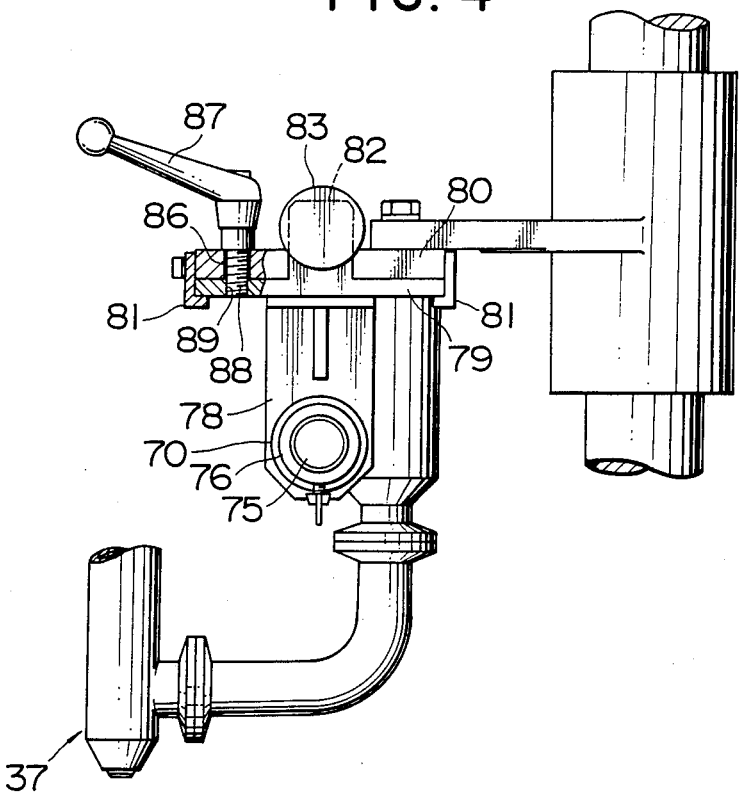

The fluid pressure cylinder 70 is suspended to a sliding plate 79 through a bracket 78. Both the front and rear edge portions of the sliding plate 79 are received by a guide member 81 having an L-shaped cross section, which is bolted up to a mounting plate 80 as shown in FIG. 4 in more detail. An upward projecting portion 82 is disposed on the center of the left edge of the sliding plate 79 and a thumb bolt 83 is disposed to the projection 82 in a freely screwed manner. Another projection 84 is also disposed at the left end of the mounting plate 80 so as to face the projection 82 and the thumb bolt 83 is screwed into a threaded hole 85 formed through the projection 84.

Moreover, a long hole 86 is formed through the mounting plate 80 in the right and left directions and the male threaded portion 88 of a lever 87 for locking is inserted through the long hole 86. In this respect, the male threaded portion 88 is also screwed into a threaded hole 89 formed through the sliding plate 79. The sliding plate 79 goes back and forth in both the right and left directions together with the fluid pressure cylinder 70 by loosening the lever 87 and rotating the thumb bolt 83. According to these operations, the range of the angle within which the nozzles 37 vibrate may be controlled as will be explained hereunder.

Figure 1:
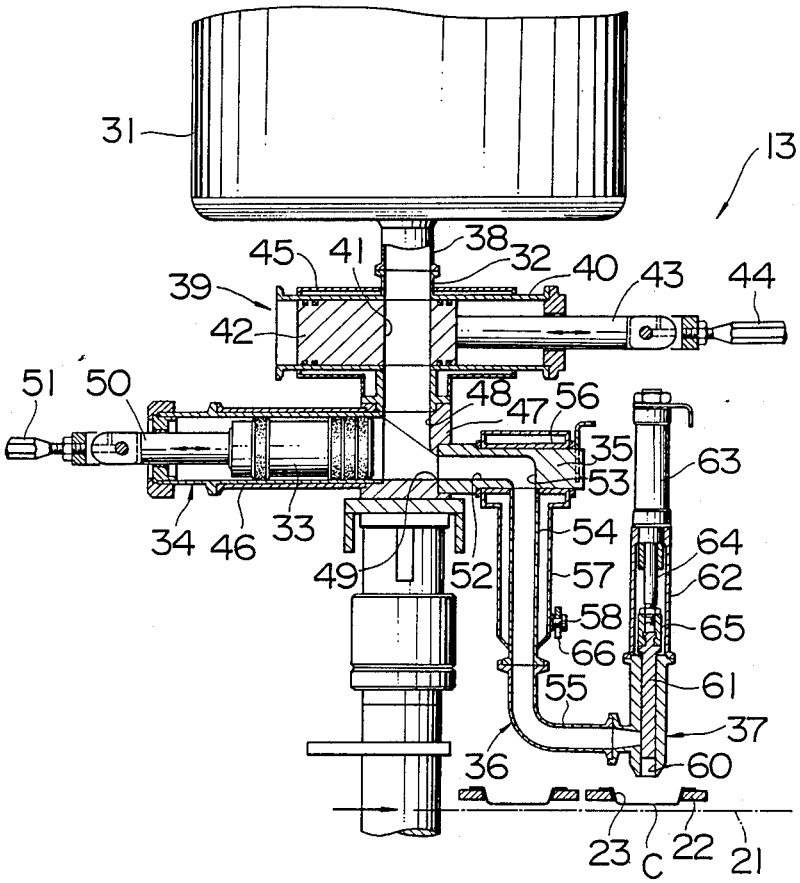
FIGS. 1 to 5 show embodiments of the device for filling a proper container with a highly viscous substance a container according to the present invention.

The operations for filling a container with the fluid substance having a high viscosity will now be explained. First of all, it is assumed that, as is shown in FIG. 1, the spool valve 39 is opened, so that the piston 33 of the filing cylinder 34 is positioned at its forward limit of the back and forth stroke, that the spool 61 of the filling nozzle 37 is in the descending state and that the discharge opening 60 of the nozzle is closed. If the piston 33 goes back from this condition, a constant amount of the fluid substance is sucked in the cylinder 34 from the tank 31. Then, if the piston 33 goes ahead while closing the spool valve 39 and opening the discharging opening 60 of the filling nozzle 37, the fluid substance in the cylinder 34 flows into the filling nozzle 37 through the horizontal axle and the interior of the arm 36 and then the substance is discharged through the discharge opening 60. At this stage, the piston rod 69 of the fluid pressure cylinder 70 is projected from its retracted state to vibrate the nozzle 37 from the state inclined toward the left direction to the state inclined toward the right direction as depicted in FIG. 2 by the dotted line.

Figure 15:
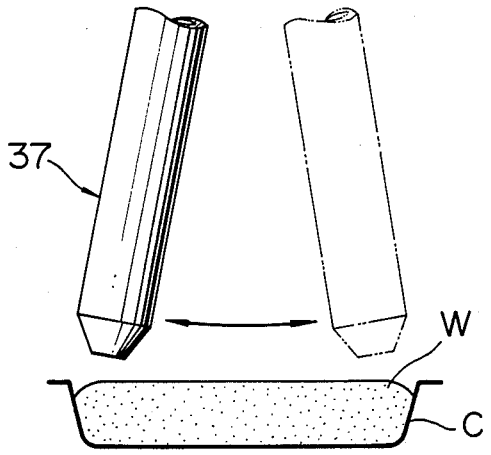
FIG. 15 is a diagram for illustrating the filling operations of the device according to the present invention.

The magnitude and the range of the vibrational stroke of the nozzles are controlled as explained above and, in this respect, the filling nozzles 37 vibrate so that the discharge opening 60 of the nozzle crosses over the container C from the right direction to the left direction while the opening faces the container C. As a result, the fluid substance is charged in the container C without causing any excess heaping although it is not completely flattened, as shown in FIG. 15. Thus, after the completion of the filling operations, the piston rod 69 of the fluid pressure cylinder 70 returns to its retracted state and the filling nozzles 37 vibrate in the direction opposite to that mentioned above, while below the nozzle 37 the container C filled with the fluid substance is replaced with an empty container C and the former is transported to the next stage such as that for sealing the container. At this stage, the aforementioned operations are repeated so that the filling cylinder 34 is refilled with the fluid substance supplied from the tank 31.

Figure 16:
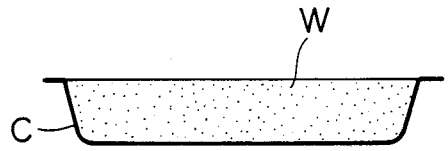
FIG. 16 is a diagram for illustrating the leveling operations.

The leveling device 14 serves to make, completely smooth, the fluid substance charged in the container C according to the aforementioned operations as seen from FIG. 16, and the device comprises a slat-conveyor 11 provided with a hammer 94 for giving a blow to the container and a member 95 for preventing the container from flying out, as shown in FIGS. 6 to 10.

Figure 7:
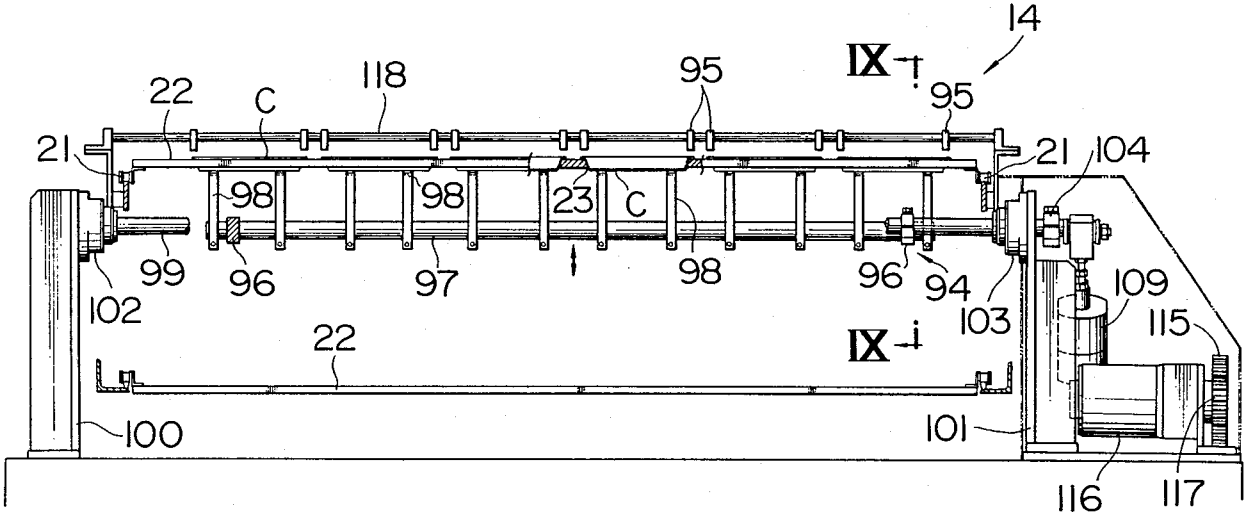
Figure 8:
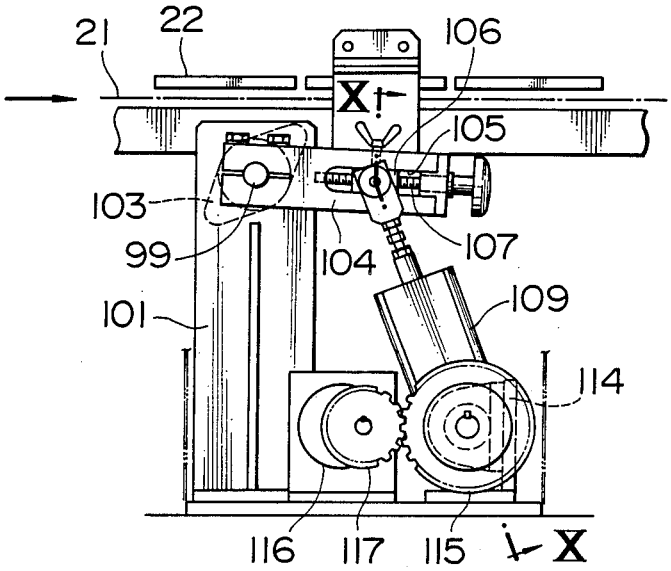
Figure 9:
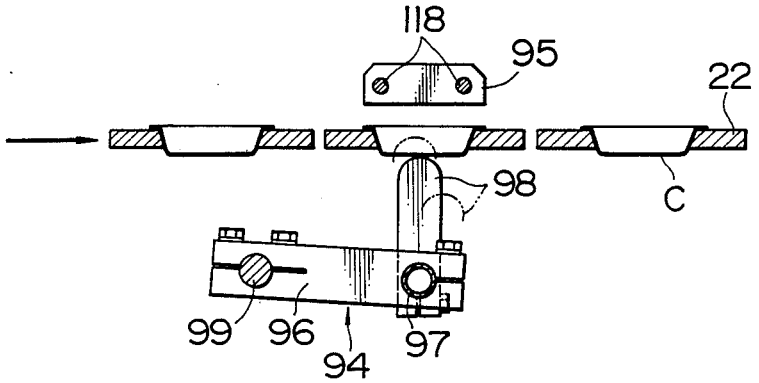
Figure 10:
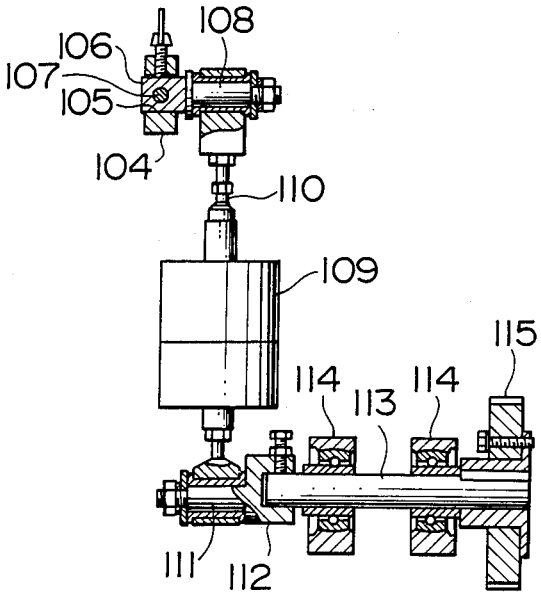

The hammer 94 comprises, as shown in FIG. 7, a pair of right and left shanks 96 horizontally arranged in parallel and twelve hammer heads 98 upwardly disposed to the front end of these shanks 96 through a connecting rod 97 which bridges over these two shanks, two each of these hammer heads 98 being assigned to one container C (in this case there are six containers in all) supported by one slat 22 which stands still at a desired position. The rear ends of the both shanks 96 are fixed to a horizontal axle 99. The both ends of the horizontal axle 99 are supported, through respective bearings 102 and 103 by, a pair of right and left brackets 100 and 101 which are stood so as to face one another and to hold the slat-conveyor 11 therebetween. The right end of the horizontal axle 99 projects in the right direction over the right supporting bracket 101 and the base portion of an arm 104 for vibration is fixed to the end of the projection. A slit 105 is formed within the arm 104 for vibration at the vicinity of the front end thereof as shown in FIG. 8 and a female screw member 106 is inserted in and engaged with the slit 105 in a freely slidable manner. The female screw member 106 is engaged with a threaded rod 107 provided with a lever so that the female screw member 106 can go ahead or back within the slit 105 by rotating the threaded rod 107. The female screw member 106 is provided with an integrated horizontal pin 108 projected toward the right direction, to which the piston rod 110 of a fluid pressure cylinder 109 is connected. The base portion of the fluid pressure cylinder 109 is connected to an eccentric axle 111 as shown in FIG. 10. The eccentric axis 111 is integrally mounted to a mounting member 112 and the mounting member 112 is bolted to a driving shaft 113 at its left end. The driving shaft 113 is supported by two bearings 114 and, at its right end, a cooperating toothed wheel 115 is mounted on the shaft. The cooperating toothed wheel 115 is engaged with a driving wheel 117 which is fixed to the output shaft of a motor 116.

Figure 6:
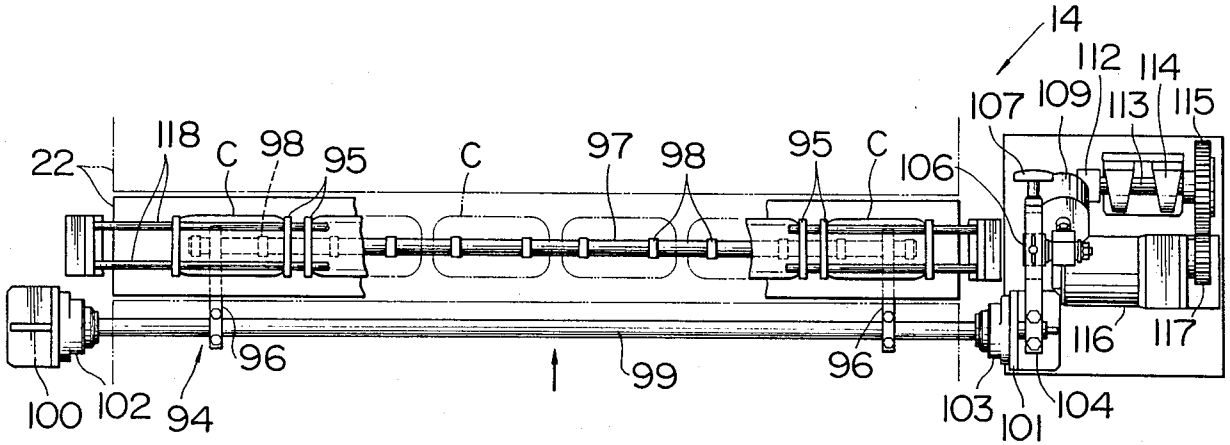
FIGS. 6 to 10 show embodiments of the leveling device as used in the present invention.

The member 95 for preventing the containers from causing flying out thereof comprises, as shown in FIGS. 6 and 7, horizontal rod-like members (for instance, twelve members in all) which are mounted to a pair of front and rear horizontal axles 118 arranged over the conveyor 11 at its right and left directions and two each of the members are assigned to one container C (in this case, there are six containers in all) similar to the hammer heads 98.

If the driving shaft 113 is rotated by starting the motor 116, a vibrational motion is transmitted to the arm 104 for vibrating the hammers through a crank mechanism comprising the eccentric axle 111 and the fluid pressure cylinder 109. Thus, the vibration of the arm 104 for vibrating the nozzles is followed by a reversible rotation of the horizontal axle 99 and as a result, the head 98 of the hammer 94 which is vibrated on the horizontal axle 99 serving as a fulcrum gives a blow to the container C filled with the fluid substance. Thus, the container C can vibrate and as a result, the fluid substance which is to fill the container to overflowing is made smooth in the container C. The amplitude and the frequency of the vibration may properly be selected dependent upon the properties of the content of the container, however, specific examples thereof are 5 mm for the amplitude and 3 to 4 cycles/sec for frequency, respectively. The adjustment of the amplitude may be attained by simply changing the position of the female screw member 106 as already explained before while the adjustment of the frequency of the vibration may also be effected by simply changing the rotational speed of the motor 116. In addition, the height of the hammer head 98 may be changed by putting the piston rod 110 of the fluid pressure cylinder 109 into reciprocating motion, which makes it possible for this device to be adapted for a variety of containers C differing in depth. On the other hand, when the hammer 94 gives a blow to the container C, the container tends to fly out from the hole 23 which receives and supports the container C and is formed on the slat 22. However, this tendency can certainly be prevented due to the presence of the member 95 for preventing the container from flying out therefrom. Moreover, if the member 95 collides with the container C to give a shock to the container C, the collision, together with the vibration of the nozzles, exerts a synergistic effect to the container in smoothening the content of the container.

As discussed above in detail, according to the device of this invention, the filling nozzles can vibrate in an appropriate amplitude and frequency during filling a container with a fluid substance having a high viscosity. Therefore, the device makes it possible to fill the container with such a fluid substance as smooth as possible without filling the container to overflowing.

What is claimed is:

1. A device for filling a container with a fluid substance of high viscosity, the container being transported on a path by a conveyor, comprising:

tank means for receiving the fluid substance;

a filling nozzle having a downwardly oriented discharge outlet and spool means for opening and closing said discharge outlet, said discharge outlet being disposed just above the path of the conveyor;

communicating means for fluid-connecting said tank means with said filling nozzle, said communicating means including discharging means for discharging the fluid substance at a constant flow rate, said discharging means comprising shut-off means for opening and shutting said communicating means and cylinder-piston means for filling the container with the fluid substance;

a vibratable arm having an upper portion and a lower portion, said filling nozzle being mounted on said lower portion of said arm;

a horizontal axle supporting said upper portion of said arm in a freely rotatable and reversible manner; and vibrating means serving as a vibration center for vibrating said arm on said horizontal axle.

2. A device for filling a container with a fluid substance of high viscosity, the container being transported on a path by a conveyor, comprising:

tank means for receiving the fluid substance;

a filling nozzle having a downwardly oriented discharge outlet and spool means for opening and closing said discharge outlet, said discharge outlet being disposed just above the path of the conveyor;

communicating means for fluid-connecting said tank means with said filling nozzle, said communicating means including discharging means for discharging the fluid substance at a constant flow rate;

a vibratable arm having an upper portion and a lower portion and a conduit therethrough, said filling nozzle being mounted on said lower portion of said arm, said conduit being fluid-connected with said communicating means at said upper portion of said arm and with said filling nozzle at said lower portion of said arm;

a hot water jacket enclosing at least a portion of said arm;

a horizontal axle supporting said upper portion of said arm in a freely rotatable and reversible manner; and vibrating means serving as a vibration center for vibrating said arm on said horizontal axle.

3. A device for filling a container with a fluid substance of high viscosity, the container being transported on a path by a conveyor, comprising:

tank means for receiving the fluid substance;

a filling nozzle having a downwardly oriented discharge outlet and spool means for opening and closing said discharge outlet, said discharge outlet being disposed just above the path of the conveyor and said nozzle and said spool having surfaces which are slidably in contact with each other and are formed from ceramic materials;

communicating means for fluid-connecting said tank means with said filling nozzle, said communicating means including discharging means for discharging the fluid substance at a constant flow rate;

a vibratable arm having an upper portion and a lower portion, said filling nozzle being mounted on said lower portion of said arm;

a horizontal axle supporting said upper portion of said arm in a freely rotatable and reversible manner; and vibrating means serving as a vibration center for vibrating said arm on said horizontal axle.

4. A device for filling a container with a fluid substance of high viscosity, the container having an opening therein and a brim formed around the edge of the opening, and the opening having a peripheral portion, comprising:

a conveyor for transporting the containers along a path, said conveyor comprising an intermittently driven slat-conveyor provided with holes for inserting the containers and slats having a peripheral part for receiving the brim of the container;

a hammer for giving a blow to the container, said hammer comprising a shank having first and second ends and a hammer head fixed at said first end of said shank;

a horizontally-disposed, reversible, rotatable driving axle, said second end of said shank being fixedly coupled to said driving axle, whereby when said axis is reversibly rotated, said hammer head can give a blow to the bottom of one of the containers received by said slat and standing still at its desired position; and retaining means for preventing the container from jumping out from said slat, said retaining means facing at least a part of the peripheral portion of the opening of the container and being spaced apart from the peripheral portion at a distance smaller than the height of the container;

tank means for receiving the fluid substance;

a filling nozzle having downwardly oriented discharge outlet and spool means for opening and closing said discharge outlet, said discharge outlet being disposed just above the path of the conveyor;

communicating means for fluid-connecting said tank means with said filling nozzle, said communicating means including discharging means for discharging the fluid substance at a constant flow rate;

a vibratable arm having an upper portion and a lower portion, said filling nozzle being mounted on said lower portion of said arm;

a horizontal axle supporting said upper portion of said arm in a freely rotatable and reversible manner; and vibrating means serving as a vibration center for vibrating said arm on said horizontal axle.

* * * * *